US011974671B1

(12) United States Patent
Critchfield

(10) Patent No.: US 11,974,671 B1
(45) Date of Patent: May 7, 2024

(54) CHAIR ANTI-TIP DEVICE

(71) Applicant: Charlotte Michael Critchfield, Buckhannon, WV (US)

(72) Inventor: Charlotte Michael Critchfield, Buckhannon, WV (US)

( * ) Notice: Subject to any disclaimer, the term of this patent is extended or adjusted under 35 U.S.C. 154(b) by 0 days.

(21) Appl. No.: 18/317,432

(22) Filed: May 15, 2023

Related U.S. Application Data

(60) Provisional application No. 63/476,714, filed on Dec. 22, 2022.

(51) Int. Cl.
*A47C 7/62* (2006.01)
*A47B 91/12* (2006.01)
*A47C 7/00* (2006.01)

(52) U.S. Cl.
CPC ..... *A47B 91/12* (2013.01); *A47C 7/62* (2013.01); *A47C 7/00* (2013.01)

(58) Field of Classification Search
CPC ... A47B 91/12; A47B 91/08; A47B 2097/008; A47B 2097/00; A47C 7/62; A47C 7/626; A47C 7/20; A47C 7/25; A47C 7/00
USPC ..... 248/188.8, 501
See application file for complete search history.

(56) References Cited

U.S. PATENT DOCUMENTS 388,981 A * 9/1888 Labarbe ..... A47C 7/506 248/240.4
801,398 A * 10/1905 Ray ..... A47C 7/52 74/564
2016/0278524 A1* 9/2016 Meinecke ..... A47C 7/62

* cited by examiner

*Primary Examiner* — Nkeisha Smith
(74) *Attorney, Agent, or Firm* — Karen Tang-Wai Sutton

(57) ABSTRACT

A chair anti-tip device comprising a frame having horizontal bars in vertical spaced apart relationship with a vertical post, and a pair of spaced apart L shaped legs rotatably connected to the frame. The chair anti-tip device is removably attached to one or more of a back, legs and stretcher of a chair by one or more removable and length adjustable straps attached to the frame and positioned around the chair. Once installed on the chair, the anti-tip device has a storage position, where the legs are rotated so as to be approximately parallel with the bars, and a use position, where the legs are rotated away from the bars to a maximum rotation of 90 degrees so as to be perpendicular with the bars. An optional suction cup and strap of the anti-tip device secures to a front stretcher of the chair for additional anti-tip properties.

20 Claims, 15 Drawing Sheets

CHAIR ANTI-TIP DEVICE

CROSS-REFERENCE TO RELATED APPLICATIONS

Reference is made to and priority claimed from U.S. application No. 63/476,714 filed on Dec. 22, 2022 under all applicable sections of Title 35 of the United States Code including but not limited to Sections 120, 121, and 365(c), and which in its entirety is incorporated by reference into this application.

STATEMENT REGARDING FEDERALLY SPONSORED RESEARCH OR DEVELOPMENT

NA

NAMES OF THE PARTIES TO A JOINT RESEARCH AGREEMENT

NA

INCORPORATION BY REFERENCE OF MATERIAL SUBMITTED ON A COMPACT DISC OR AS A TEXT FILE VIA THE EFS WEB SYSTEM

NA

STATEMENT REGARDING PRIOR DISCLOSURES BY THE INVENTOR OR A JOINT INVENTOR

NA

BACKGROUND OF THE INVENTION

Field of the Invention

The invention pertains to the field of furniture stabilization, specifically, a removable anti-tip device for a chair.

Background Art

There is a plethora of safety seats geared towards young children. Current popular booster seats are designed to raise the child to an appropriate height to sit at the table and include seat belts designed to prevent a fidgety child from climbing out of the chair, and potentially falling while fidgeting. While booster seats have largely replaced old standbys of children sitting on pillows or stacks of books, the booster seat has created a new serious problem of backwards tipping injuries. Many adults first become aware of this danger while making a trip to the ER with their injured child. Fall injuries suffered by young children, who are too old for highchairs but are too small to sit without a booster seat in an adult chair, are the number one injury seen in emergency rooms across the United States.

The design of the booster seat enhances the backwards tipping risk to the seated child. The child seated in a booster seat on an adult chair has a higher center of gravity than an adult sitting on the same chair, and the child's feet are often positioned near the apron of the table. The apron is a continuous strip of metal or wood attached to an underside of the tabletop that helps support the table surface. The higher center of gravity of the seated child with the apron location is a potentially dangerous combination. When the seated child's feet push against or kick the apron, the chair easily tips backwards. These accidents occur quickly, and seated adults often do not have enough time to respond to prevent falls because the danger is neither recognized nor anticipated.

In particular, the seat belt for the booster seat all but guarantees that the seated child sustains a back head injury that can be life-threatening. Since the primary purpose of the booster seat is to position the child at a comfortable eating height, the child's head and neck are often well above the back of the chair, which would otherwise be protective against backwards falls. A belted child thus has no way to break a fall by falling or otherwise turning sideways, and thus the back of the head hits the floor. Again, this danger is unique to children sitting in booster seats due to the higher center of gravity of the seated child. Since adults rarely fall backwards in chairs, the height of the back of the seat is primarily designed as a back rest, thus even for adults the back of the chair is rarely taller than an average adult's shoulders.

What is needed is a chair anti-tip device that can be used with any standard dining room or bar height chair with a back rest portion and two or more legs.

What is also needed is a chair anti-tip device that can be removably installed on a chair and when not in use, can be safely left installed on the chair without creating tripping hazards.

What is finally needed is a chair anti-tip device that is portable.

DISCLOSURE OF INVENTION

In a first aspect of the invention, an anti-tip device for use with a chair is comprised a bar having a first end, a second end and a middle portion between the first end and the second end, a connector, and a first leg having a bar end and a floor end, the first leg rotatably affixed to the bar by the connector and a fastener removably affixing the bar to the chair. Rotating the leg so as to be perpendicular to the bar positions the leg in a use position and rotating the leg so as to be parallel with the bar positions the leg in a storage position.

In a second aspect of the invention, the connector is a hinge attaching the leg to the bar in a first embodiment. In a second embodiment, the leg is a tube inserted into and rotating within the connector, which is further comprised of a slot and a stop attached to the leg inside the connector, with the stop travelling within the slot so as to limit rotational travel distance of the leg within the connector.

In yet a third aspect of the invention the leg in a first embodiment is L-shaped, and in a second embodiment is a right-angle triangle. In both embodiments, the leg has a bar end affixed to the connector and a floor end positioned on a floor surface when the anti-tip device is in a use position.

In a fourth aspect of the invention, the fastener of the anti-tip device is an adjustable strap that removably secures the anti-tip device to the chair. An optional suction cup attached to a strap is also provided and is used to secure a front portion of the chair to the floor surface.

In a fifth aspect of the invention, the anti-tip device is further comprised of a second leg in space-apart relationship with the leg, and wherein the second leg is perpendicular to the bar when in the use position and parallel to the bar when in the storage position.

In a sixth aspect of the invention, the chair used with the anti-tip device has at least two chair legs, with at least one of the chair legs having a back leg portion, a stile, and optionally a stretcher between the chair legs.

In a seventh aspect of the invention, the anti-tip device is comprised of a frame having a vertical post with an upper bar and a lower bar, the upper and lower bars positioned so as to be perpendicular to the post, with two legs in spaced apart relationship rotatably attached to the upper bar. One or more fastener straps removably attach the anti-tip device to the chair.

In an eighth aspect of the invention, the anti-tip device is further comprised of a base affixed to the lower bar, the base adapted to receive a foot of the chair leg.

In a ninth aspect of the invention, the anti-tip device includes a T-bar attached to the post, wherein the T-bar is perpendicular to the post and rests against either the first chair leg or the second chair leg when in the use position. The T-bar typically is covered in a non-slip material. In one embodiment, the T-bar is additionally rotatably affixed to the post or otherwise adjustable.

BRIEF DESCRIPTION OF THE DRAWINGS

The features and advantages of the invention will become apparent from a consideration of the subsequent detailed description presented in connection with accompanying drawings, in which.

DRAWINGS LIST OF REFERENCE NUMERALS

Figure 1:
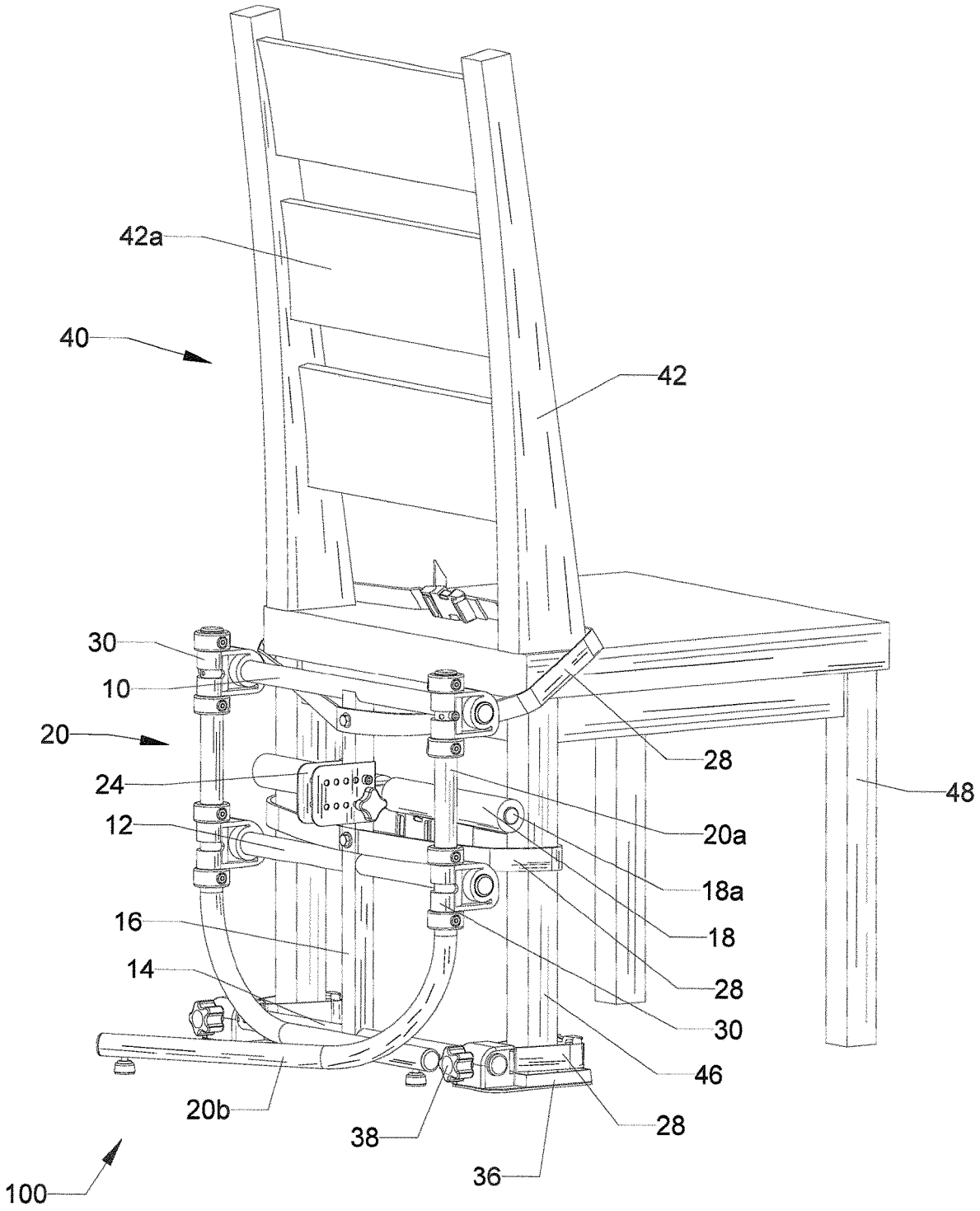
FIG. 1 is a first perspective view of a chair anti-tip device according to the invention or device, shown installed on a representative wooden dining room chair with the device shown in a storage position.

The following is a list of reference labels used in the drawings to label components of different embodiments of the invention, and the names of the indicated components:

100 anti-tip device or device
10 top bar
10*a* first end of top bar
10*b* second end of top bar
10*c* midpoint of top bar
12 middle bar
12*a* first end of middle bar
12*b* second end of middle bar
12*c* midpoint of middle bar
14 bottom bar
14*a* first end of bottom bar
14*b* second end of bottom bar
14*c* midpoint of bottom bar
16 post
18 stabilizer T-bar
18*a* pad
20 leg
20*a* bar end of leg
22 front foot
24 plate
24*a* aperture
26 adjustable fastener
28 strap
30 connector
32 slot
34 screw or stop
36 base plate
38 adjuster
40 chair
42 stile (supports back and rear of apron)
42*a* chair back
44 stretcher or spindle
46 rear leg
48 front leg
50 suction cup

DETAILED DESCRIPTION

A chair anti-tip device according to the invention or device 100 is shown in FIGS. 1-14. Turning now to the FIGS., the device 100 in the embodiment shown is comprised of a frame having a post 16 at a midpoint 10*c* 12*c* 14*c* of three bars 10 12 14 positioned in spaced apart relationship on the post 16, with an upper or top bar 10 positioned at an upper end of the post 16, a bottom bar 14 positioned at a lower end of the post 16 and a middle bar 12 positioned between the top bar 10 and the bottom bar 14, with the post 16 positioned at a midpoint 10*c* 12*c* 14*c* of each bar 10 12 14.

In the embodiment shown in the FIGS., each bar 10 12 14 is shown configured as a pair of opposed bars, with one bar of the pair on opposite sides of the post 16 however the bars 10 12 14 could also be configured as a single bar mechanically affixed to one side of the post 16. In some embodiments (not shown), at least one of the bars 10 12 14 is removably affixed to the post 16 so as to be adjustable in height along a length of the post 16 for more economical shipping, particularly for embodiments where the device 100 is sold disassembled. The frame can also be configured as a single, non-adjustable member. Each of the bars 10 12 14 has a first end 10*a* 12*a* 14*a* and a second end 10*b* 12*b* 14*b* corresponding with left and right sides of the device 100.

A stabilizer T-bar 18 having an exterior covered at least in part by a pad 18*a* made of foam, rubber, or other cushioning or non-skid material positioned along at least a chair-contacting side of the T-bar 18 is adjustably connected to the post 16 by a center plate 24 formed with one or more apertures 24*a* into which an adjustable fastener 26 is positioned. The post 16 is further formed with a through-hole (not shown) sized and shaped to additionally receive the adjustable fastener 26 so as to allow a user to affix the plate 24 of the T-bar 18 to the post 16. In the embodiment shown in FIG. 8 for instance, the T-bar 18 is formed with two plates 24 in spaced apart relationship extending away from the bar to form a U-shape fitting around opposite sides of the post 16, however a single plate 24 can sufficiently secure the T-bar 18 to the post 16. The plate 24, apertures 24*a* and adjustable fastener 26 allow the device 100 to be adjusted closer to or further away from a chair 40 to which the device 100 is installed by adjusting the T-bar 18 relative to the bars 10 12 14. The T-bar 18 can also be rotatably or otherwise removably affixed to the post 16 to enhance portability.

The T-bar 18 is typically a same length as the top, middle and bottom bars 10 12 14, however, the T-bar 18 must be at least a same length as a width measurement taken across both rear legs 46 of the chair 40 as the T-bar 18 must either rest against both rear legs 46 so has to have 2 points of contact with the T-bar 18, or alternatively rest against a spindle or stretcher 44 attaching the rear legs 46, or in the case of the chair 40 being configured with only a single rear leg 46, the T-bar 18 must have sufficient contact with the single rear leg 46 of the chair 40 to prevent the T-bar 18 from rotating. The T-bar 18 and bars 10 12 14 must be approximately parallel with a chair back 42*a* for optimal anti-tip stability of the chair 40. The T-bar 18 padding 18*a* serves to prevent damage to the chair 40, as well as to space the device 100 further away from the rear legs 46 of the chair 40 as desired.

The through hole formed in the post 16 is typically positioned between the top bar 10 and the middle bar 12, with the top bar 10 being positioned at an uppermost end of the post 16, however in some embodiments (not shown), if the post 16 extends beyond the top bar 10, that is, if the top bar 10 is not positioned at the uppermost end of the post 16, the T-bar 18 may in fact be joined to the post 16 above the top bar 10. The bars 10 12 14 and post 16 are typically configured as tubes with a hollow core having a square or circular cross section.

Figure 2:
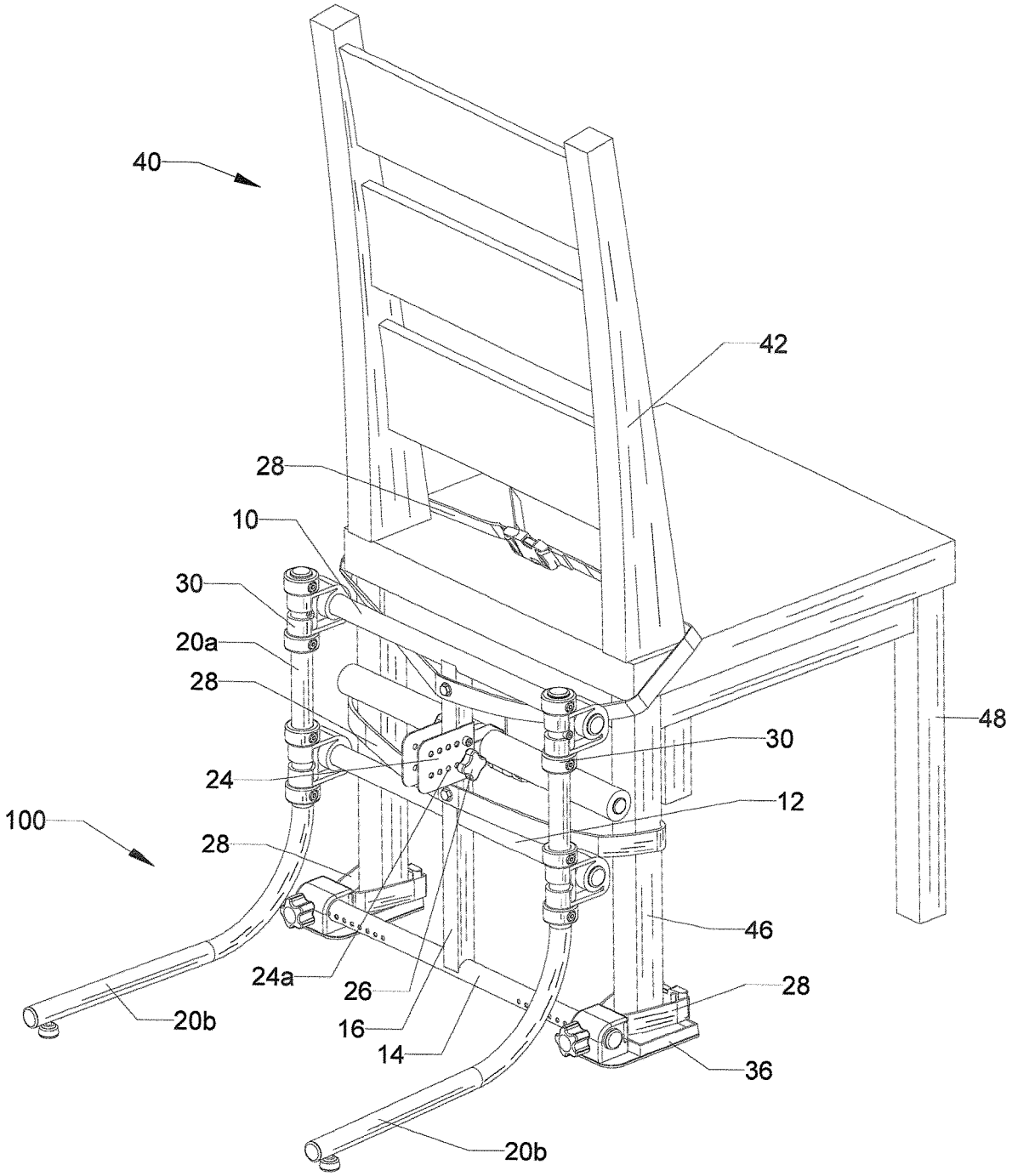
FIG. 2 is a second perspective view of the chair anti-tip device in FIG. 1, shown with the device in a use position.
Figure 3:
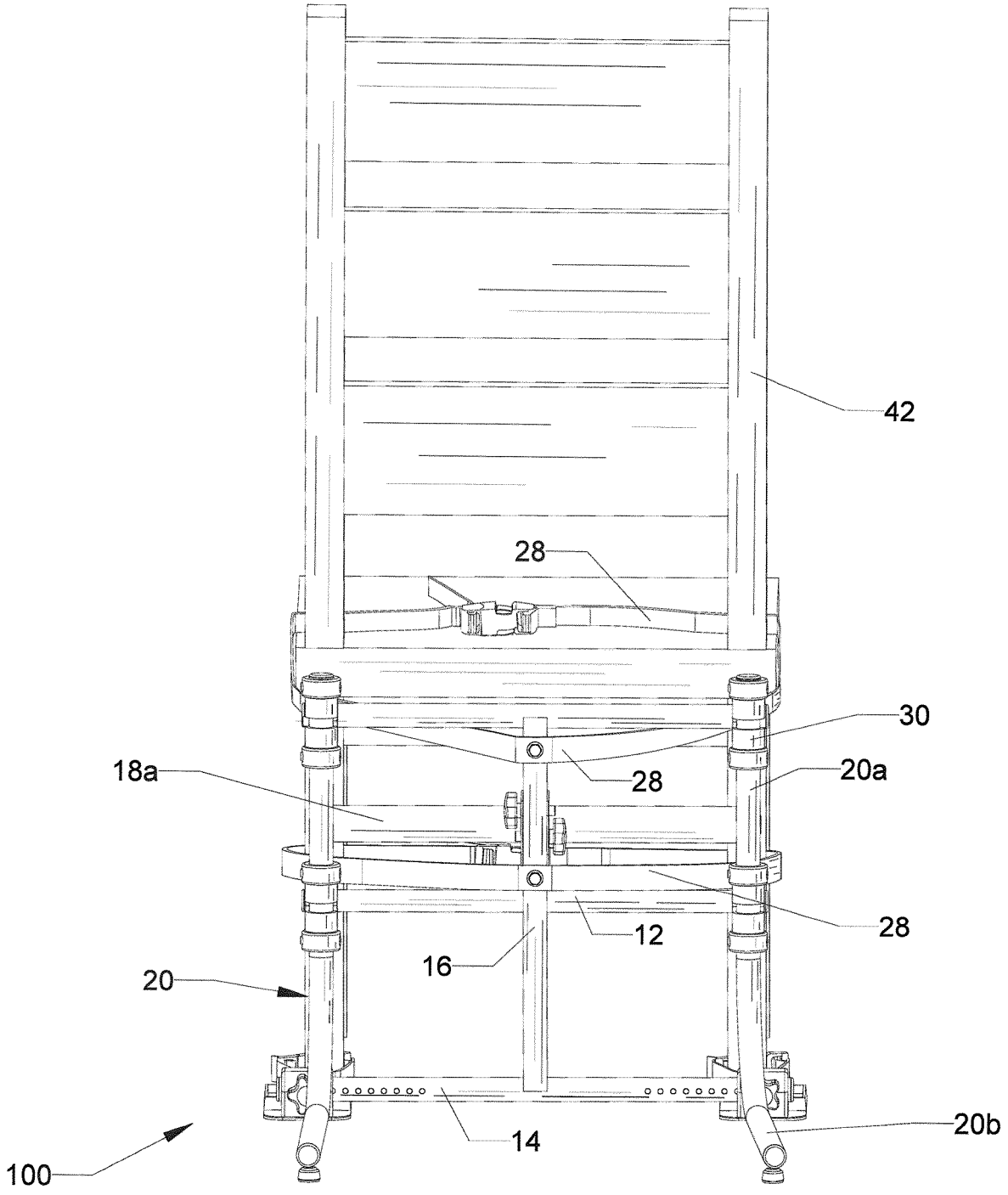
FIG. 3 is a back view of the chair anti-tip device in FIG. 2, shown in the use position.
Figure 4:
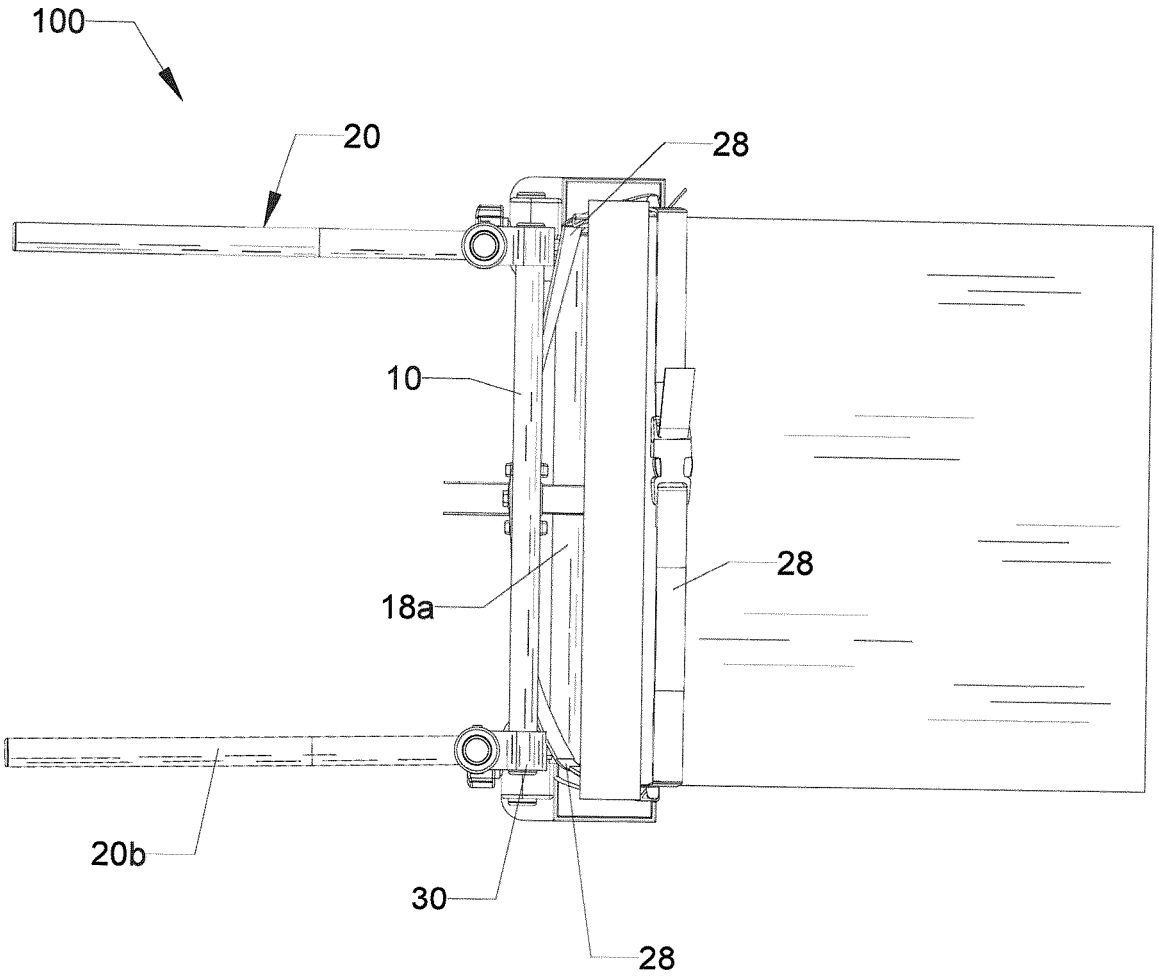
FIG. 4 is a top view of the chair anti-tip device shown in the use position.

The device 100, in the representative embodiment shown in the FIGS., is further formed with two legs 20 in spaced apart relationship, rotatably connected to the top bar 10 by a connector 30 positioned on each of the first end 10*a* and second end 10*b* of the top bar 10, and similarly on each of the middle first end 12*a* and middle second end 12*b* of the middle bar 12. Each leg 20 has a bar end 20*a* and a floor end 20*b*, forming an approximately L-shaped leg for stability. A front foot 22 is positioned on a floor facing side of the floor end 20*b* of the leg 20. The connector 30 has a cylindrical leg receiver into which the bar end 20*a* of the leg 20 is positioned; the bar end 20*a* of the leg 20 necessarily has a circular cross section sized and shaped to fit into the connector 30 leg receiver to allow the bar end 20*a* of the leg 20 to rotate within the connector 30. When the legs 20 are rotated so as to be approximately parallel with the bars 10 12 14, the device 100 when installed on the chair 40 is in a storage position, as shown in FIG. 1. When the legs 20 are rotated 90 degrees from the bars 10 12 14, the installed device 100 is now in a use position, as shown in FIG. 2.

To control rotation of the leg 20 within the connector 30, the connector 30 is further formed with a slot 32 sized and shaped to receive a stop 34, configured as a protruding screw or peg-like member attached to the bar end 20*a* of the leg 20 and positioned within the slot 32. The stop 34 and slot 32 prevent over rotation of the leg 20 within the connector 30 to ensure that the leg 20 in the use position is not accidentally over rotated and fails to maintain its use position. The stop 34 also prevents the bar end 20*a* of the leg 20 from accidentally being removed from the connector 30.

The embodiment shown in the FIGS. show a total of four connectors 30, two per leg 20, with a lower positioned connector 30 connecting the bar end 20*a* of the leg 20 to the middle bar 12 for further durability and strength.

The floor end 20*b* of the leg 20 is further formed with a foot 22 at one end typically with a threaded shank to allow a use to self-adjust the foot 22 to ensure that each leg 20 sits flush against a floor surface and to accommodate uneven surfaces. Typically, each leg 20 has one foot 22 however two or more can be used per leg 20 as desired or needed.

The bottom bar 14 in the embodiments shown in the FIGS. is formed with a base plate 36 having a non-slip surface, the base plate 36 sized and shaped to receive a chair foot or lowermost portion of the rear chair leg 46. The base plate 36 however is optional and the inventor notes that the position of the T-bar 18 may result in the lowermost portions of the rear chair legs 46 from being able to rest on the base plates 36. Adjustable straps 28 affixed to the post 16 and to the bottom bar 14 allow the user to further secure the device 100 to the chair 40, although these are also optional for use. The design of the device 100 allows use with a variety of different chair styles as shown in the FIGS. where in FIG. 1, the device 100 is affixed to the classic wooden dining room chair, and in FIG. 6 to the tall barstool-style chair. The device 100 thus is capable of being used with a variety of common chair designs.

Figure 5:
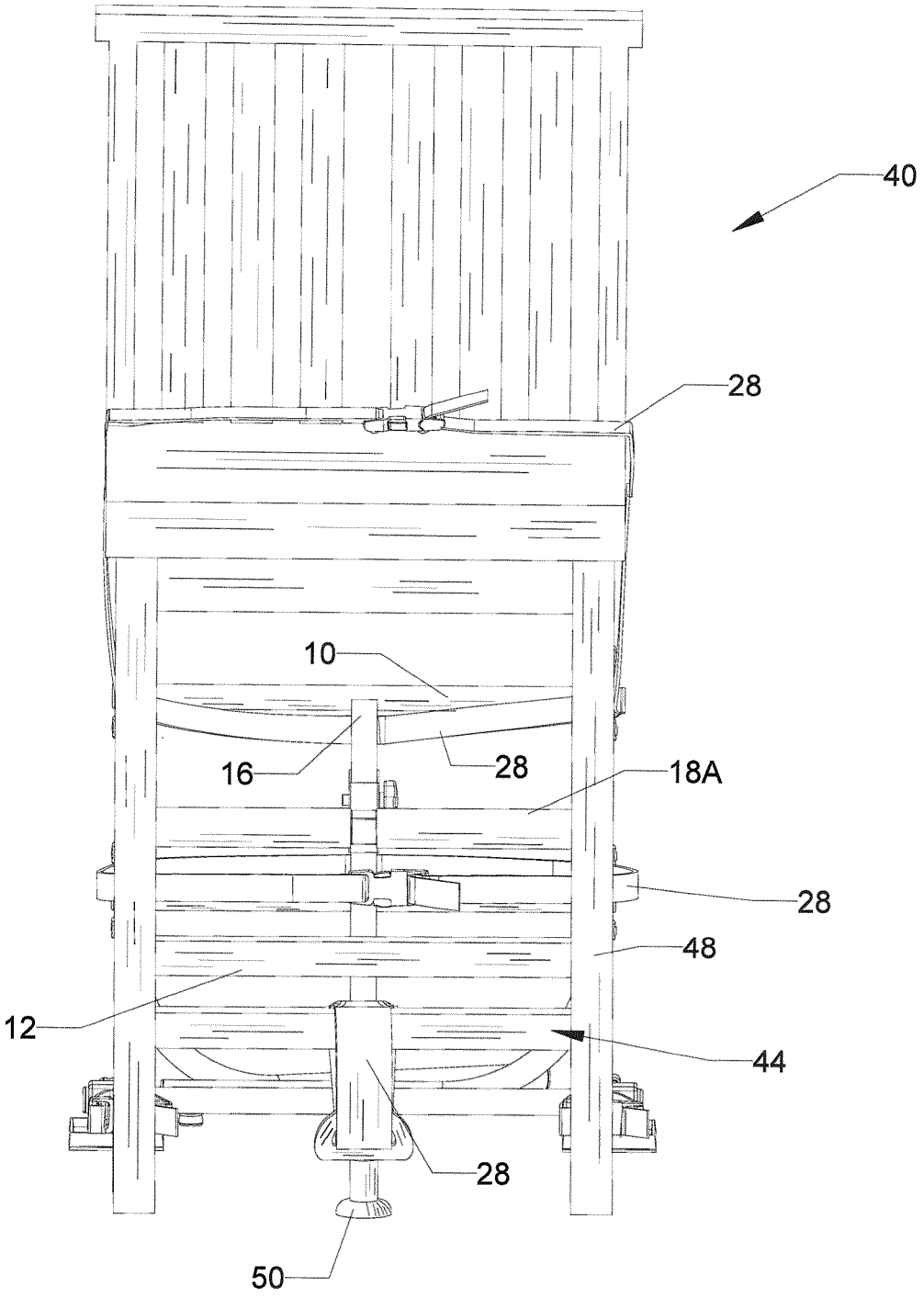
FIG. 5 is a front view of a barstool-style chair with the chair anti-tip device installed, showing an optional suction cup and strap attached to a stretcher of the chair.
Figure 6:
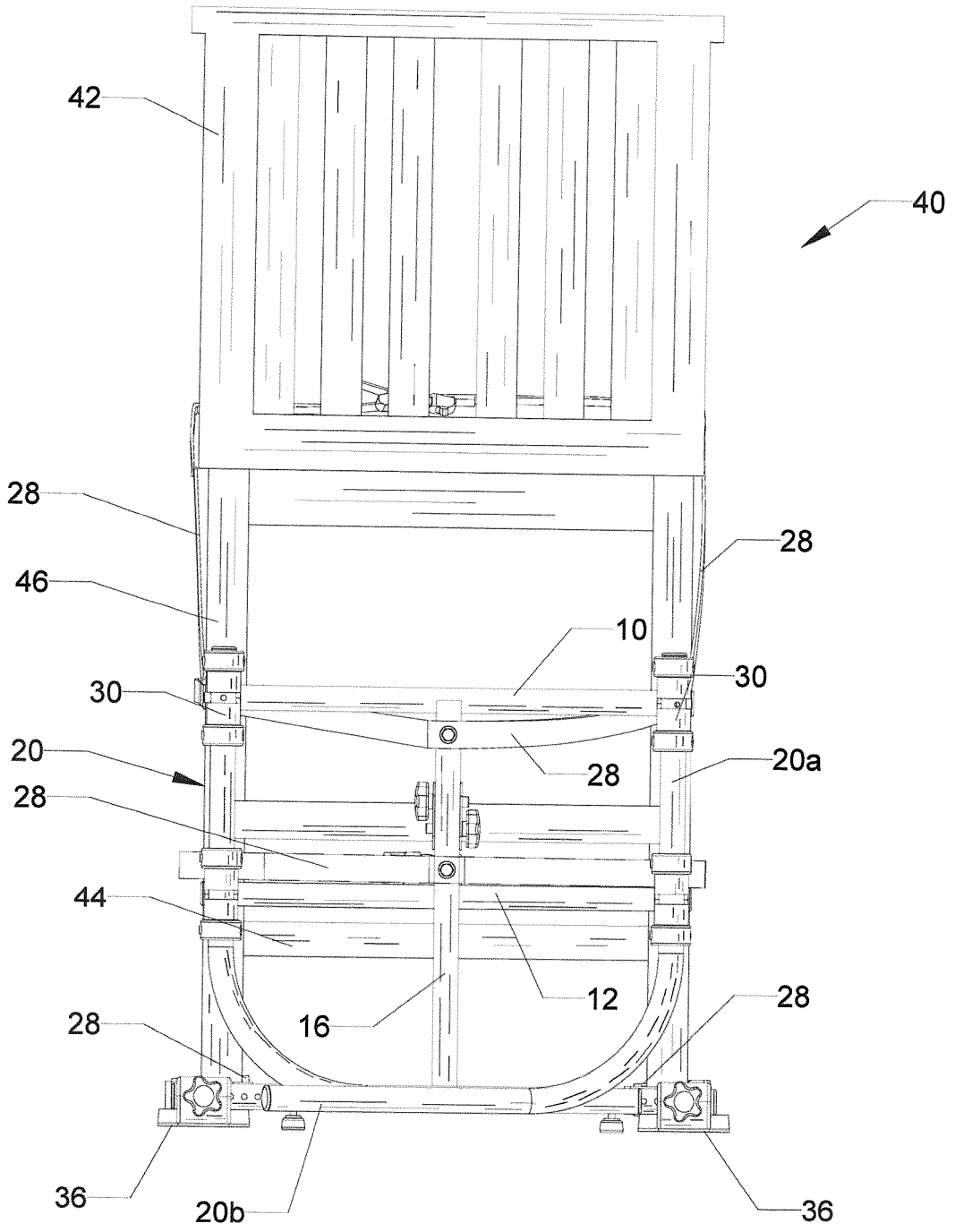
FIG. 6 is a back view of the barstool-style chair in FIG. 5, showing the chair anti-tip device installed on the chair and in the storage position.
Figure 7:
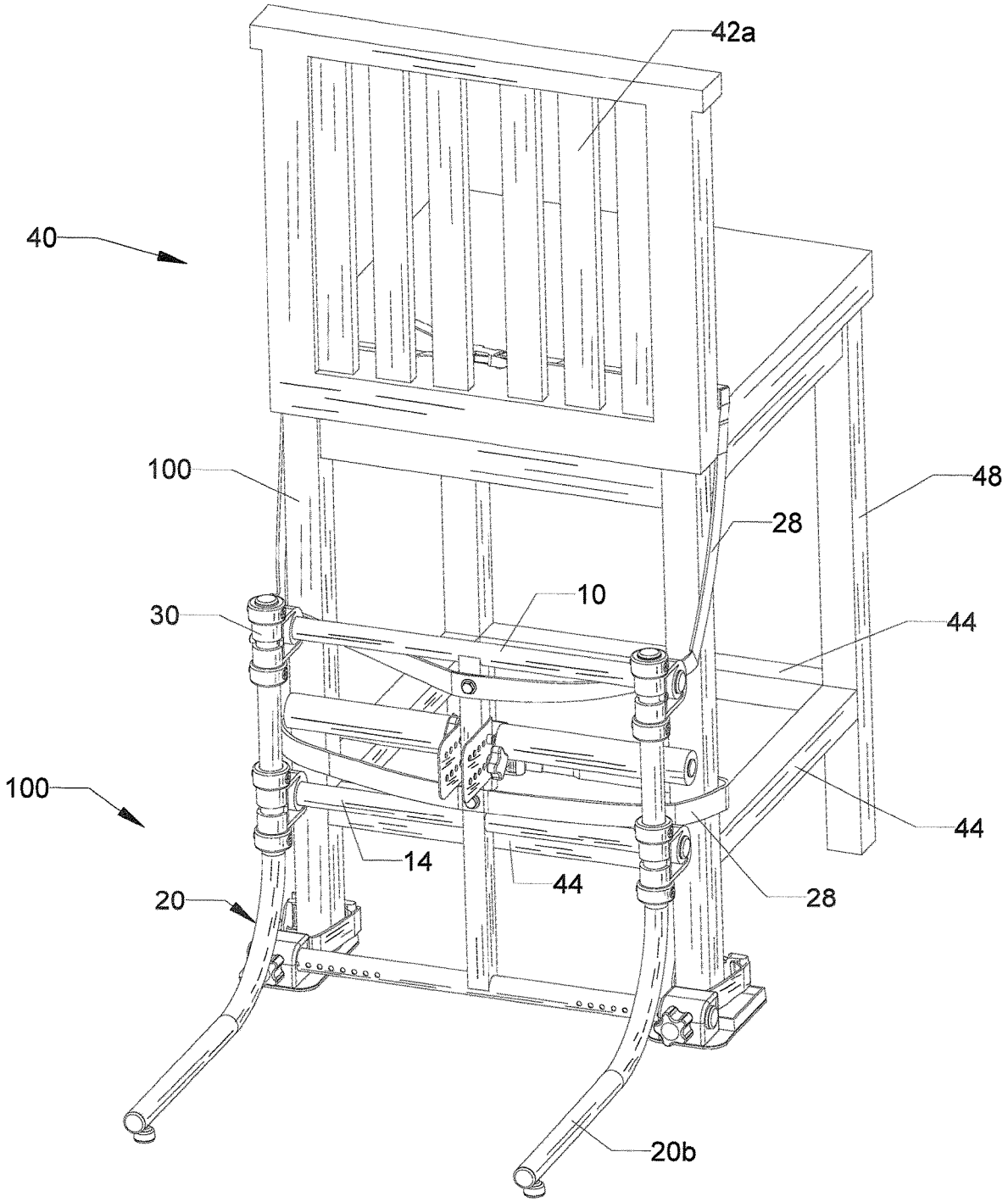
FIG. 7 is a back perspective view of the barstool-style chair in FIG. 6, showing the chair anti-tip device in the use position.
Figure 8:
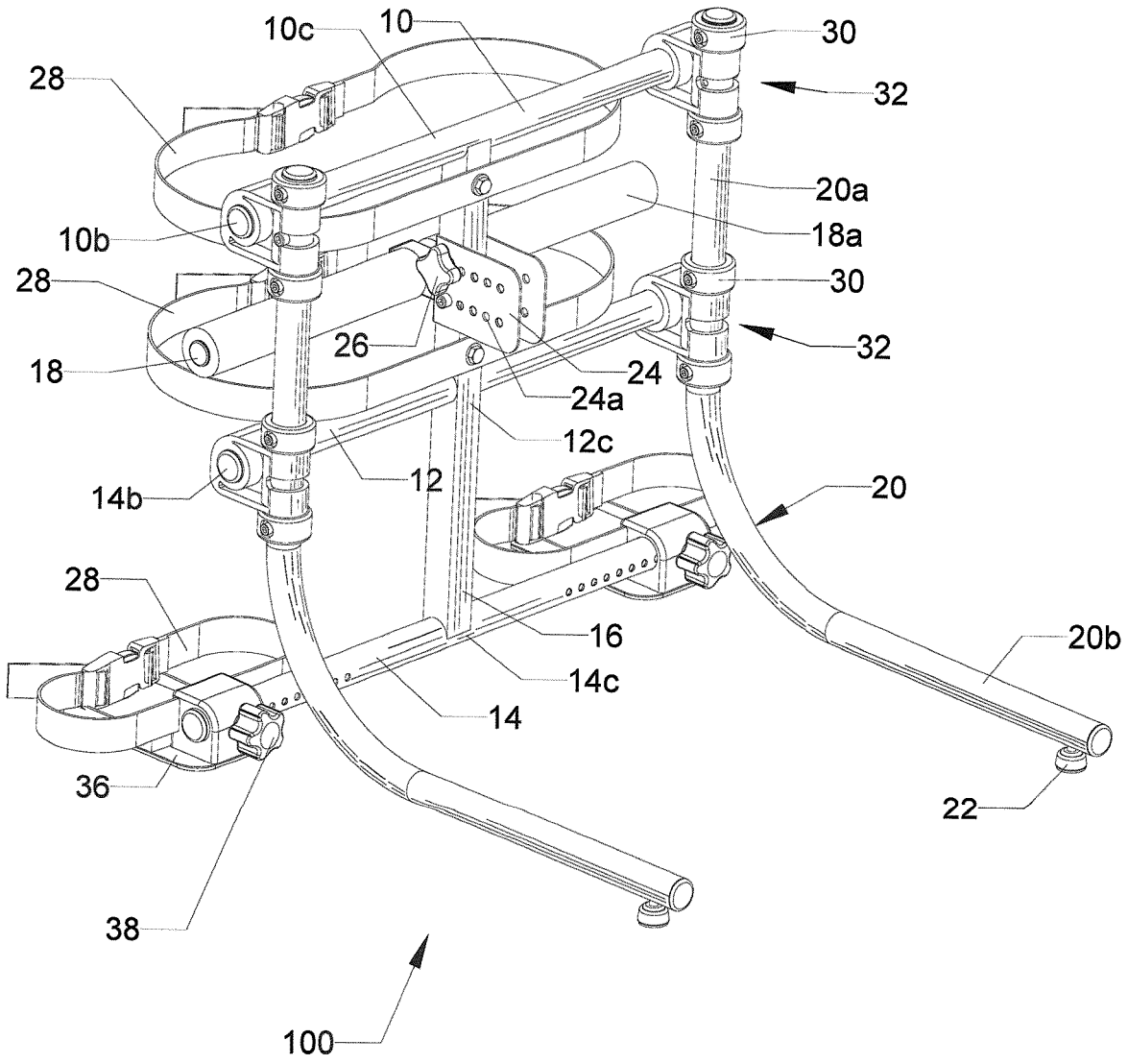
FIG. 8 is a front perspective view of the chair anti-tip device according to the invention.
Figure 9:
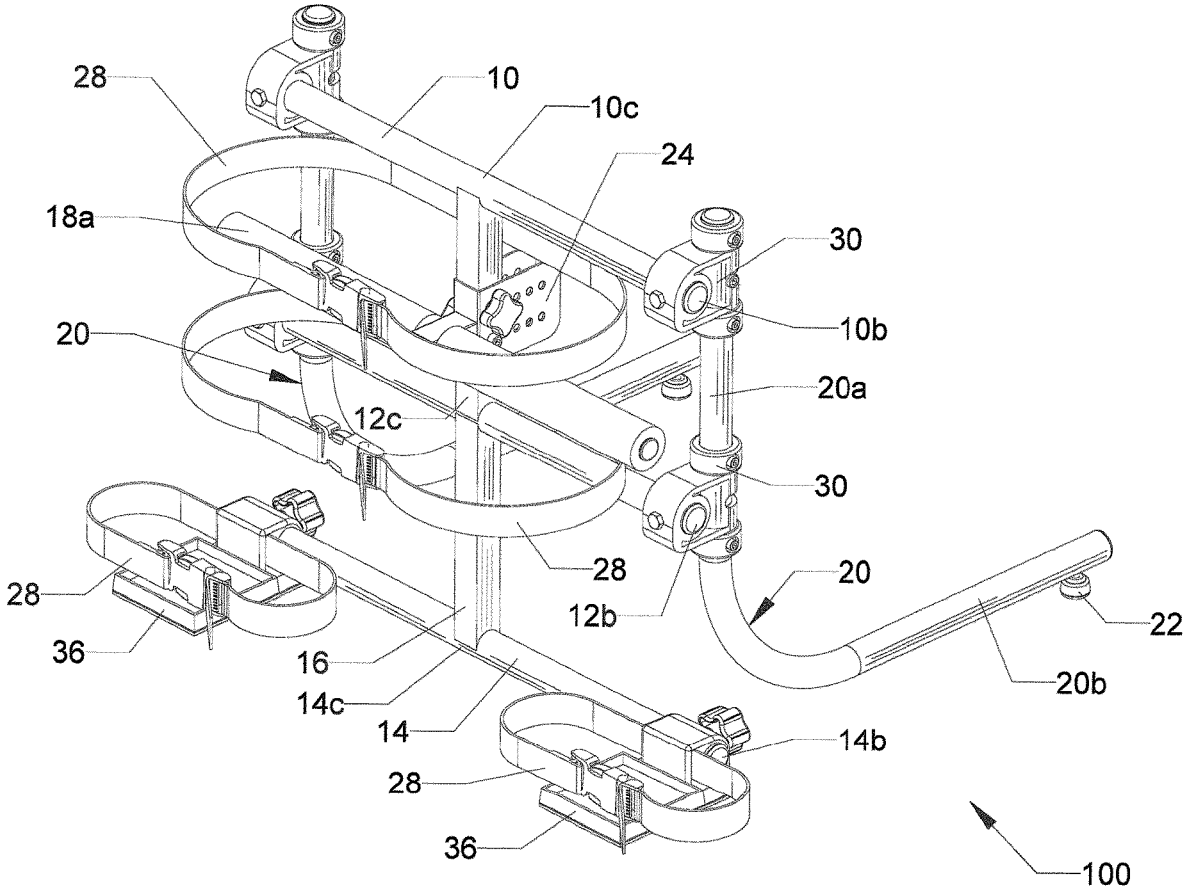
FIG. 9 is a back perspective view of the chair anti-tip device according to the invention.
Figure 10:
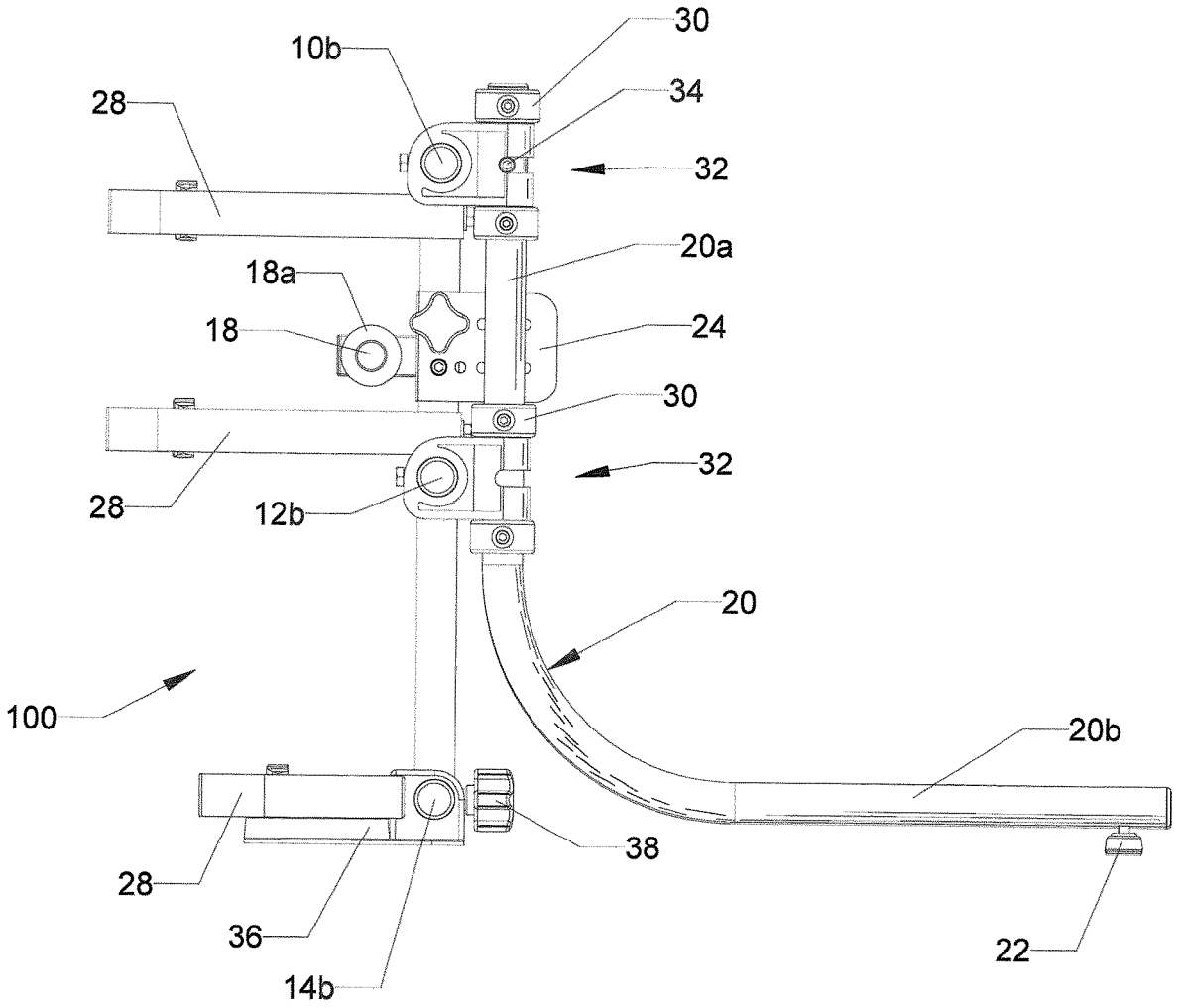
FIG. 10 is a left side view of the chair anti-tip device according to the invention.
Figure 11:
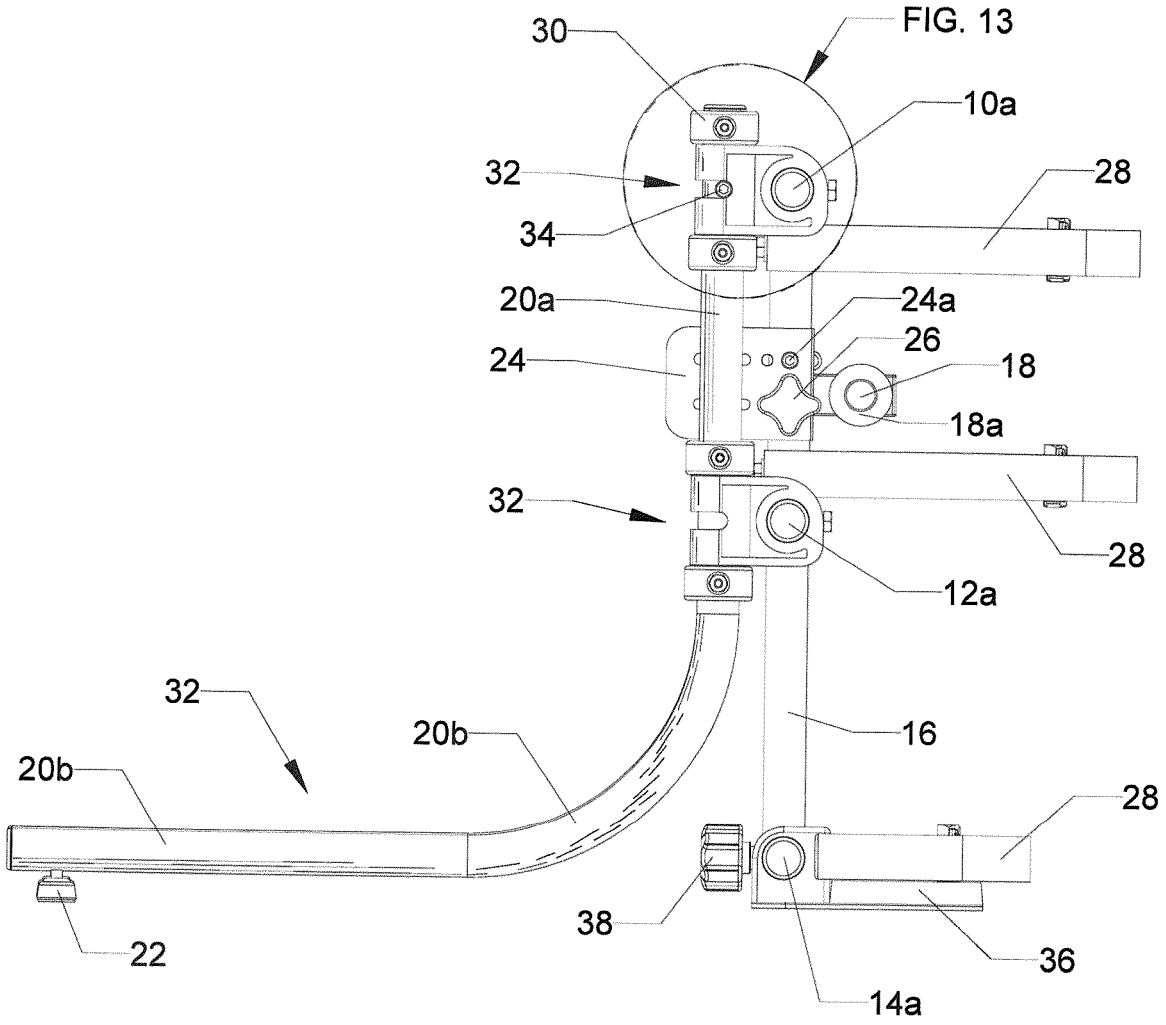
FIG. 11 is a right side view of the chair anti-tip device according to the invention.
Figure 12:
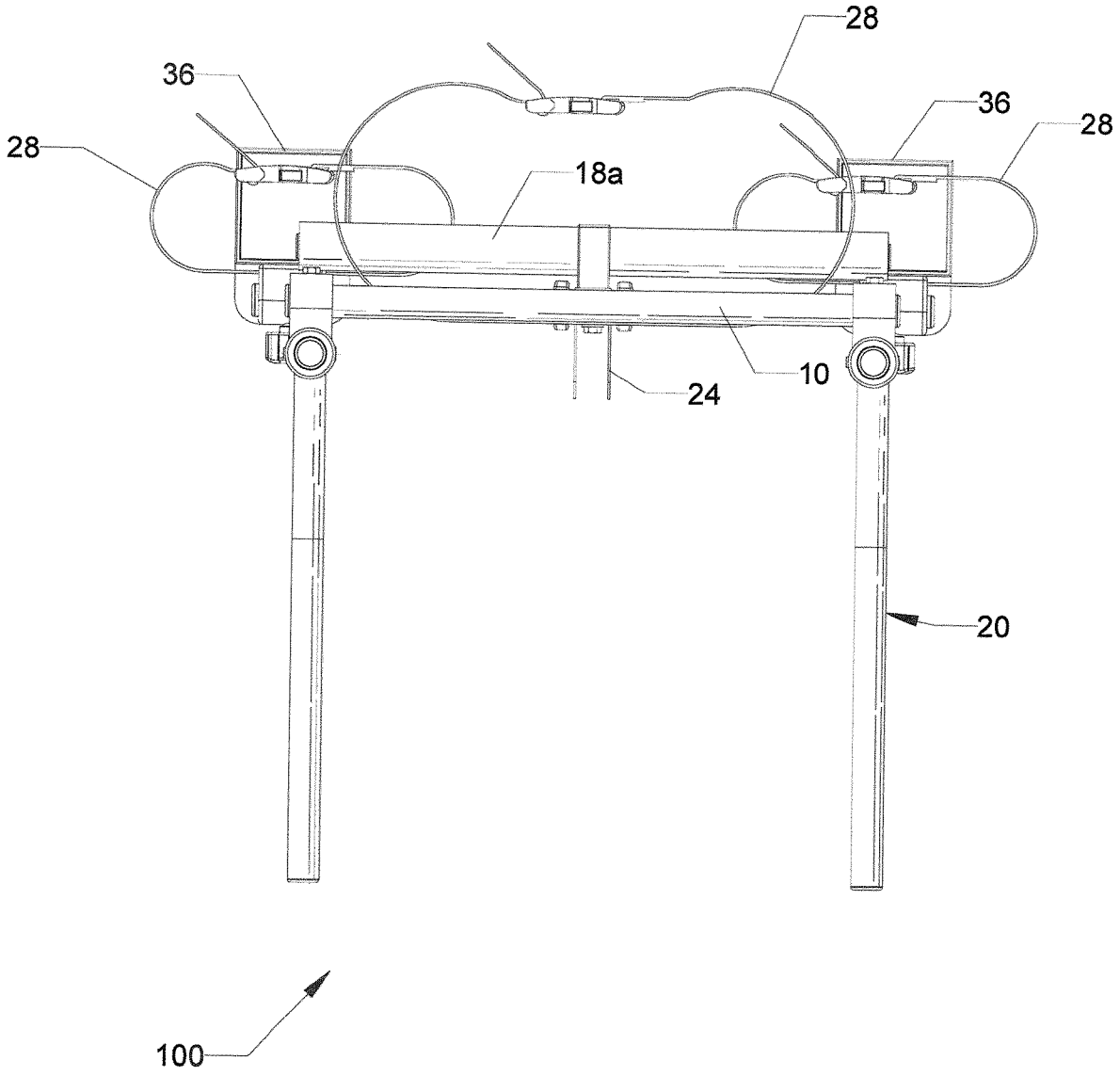
FIG. 12 is a top view of the chair anti-tip device according to the invention and FIG. 12A is a perspective view of the optional suction cup and strap.
Figure 12A:
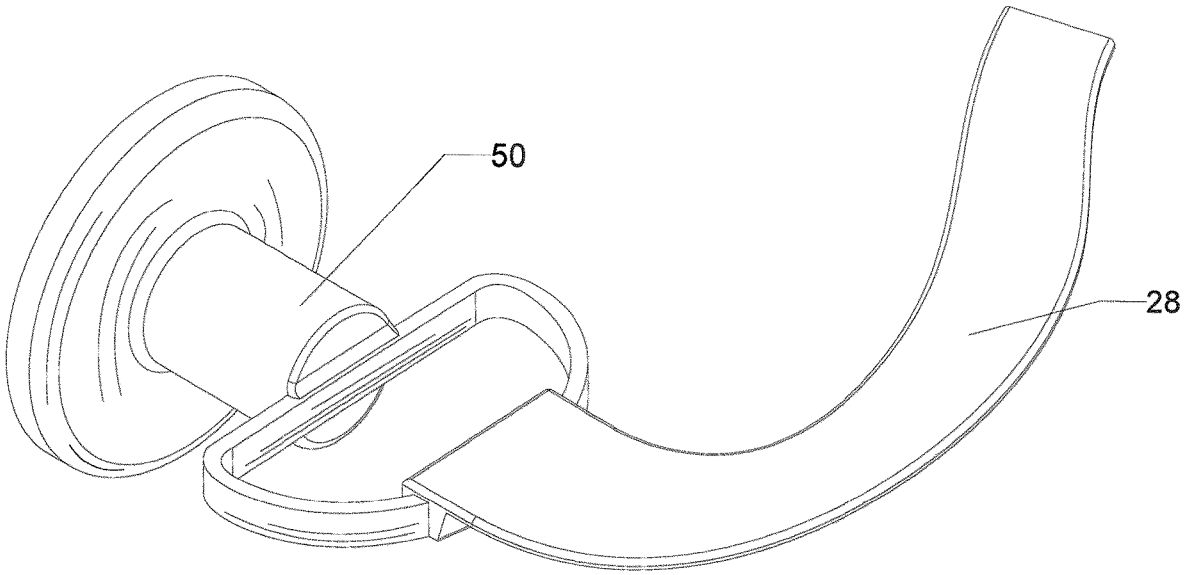
Figure 13:
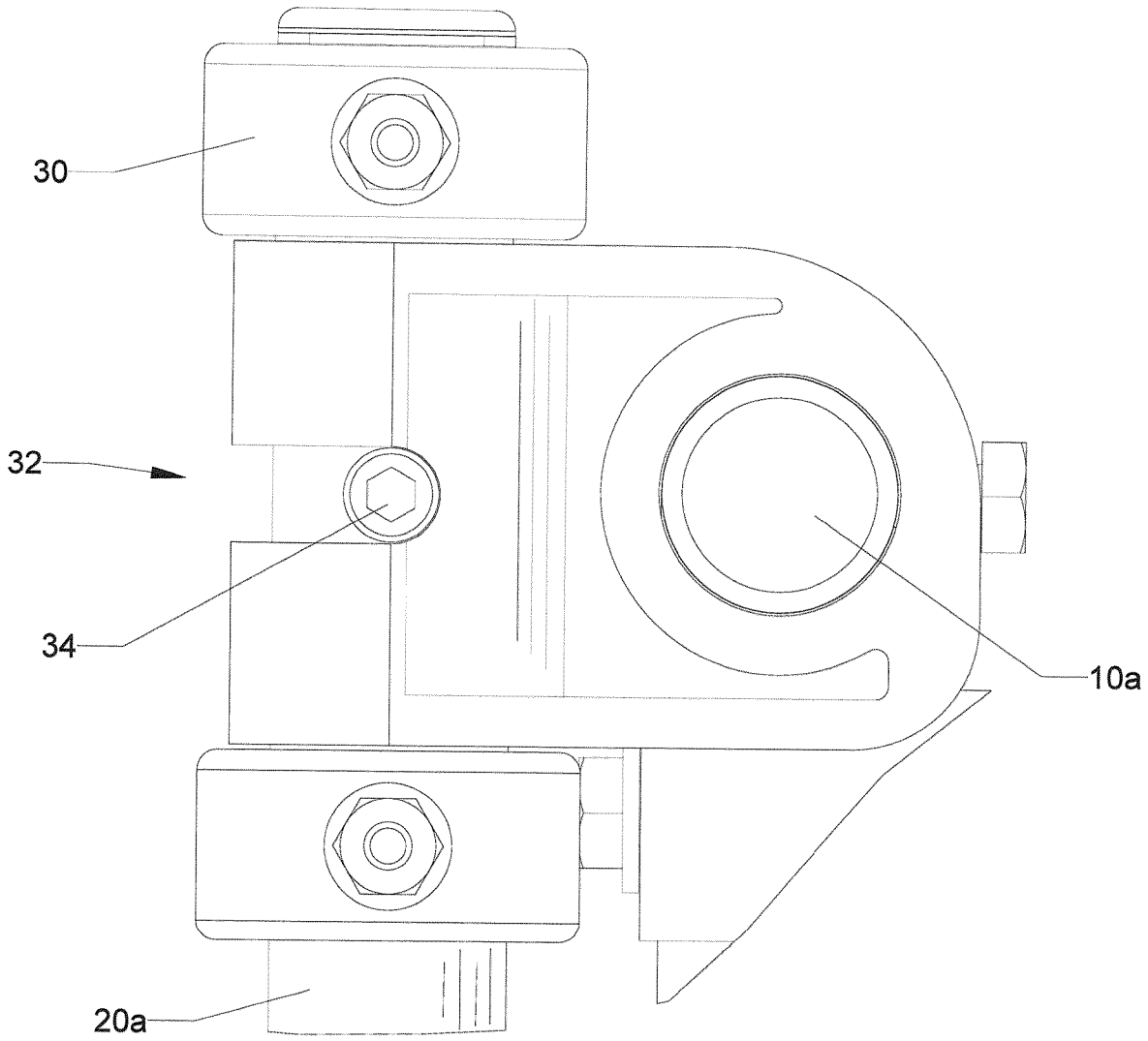
FIG. 13 is a detail view of a slot and stop mechanism of a connector of the chair anti-tip device.
Figure 14:
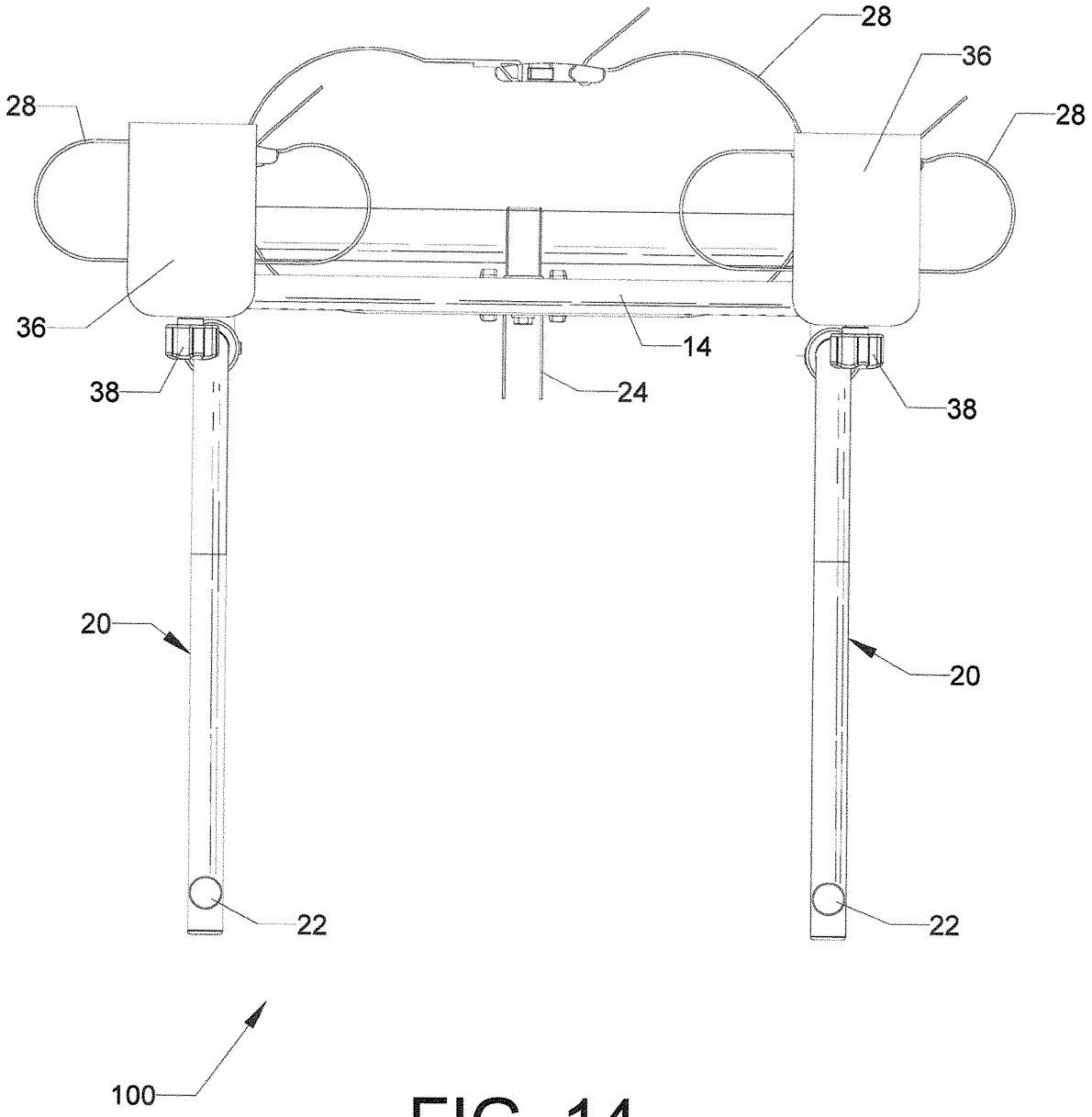
FIG. 14 is a bottom view of the chair anti-tip device according to the invention.

For the embodiment shown in the FIGS., an uppermost positioned adjustable strap 28 is designed to go around the back 42*a* and stiles 42 of the chair 40, just above a rear apron of the chair 40. A middle adjustable strap 28 secures the device 100 to the rear chair legs 46, the stretcher 44 or combinations thereof. For extra security, a suction cup 50 attached to another adjustable strap 28 is attached to the stretcher 44 between a pair of front legs 48, as shown in FIG. 5.

To use the device 100, the adjustable straps 28 are opened and the device 100 positioned so that the base plates 36 are beneath the lowermost ends of the rear chair legs 46 and the T-bar 18 rests against the rear chair legs 46 and/or the stretcher 44. If the user wants the installed position of the device 100 to maximize the anti-tip security, the T-bar 18 is adjusted using the adjustable fastener 26 to position the pad 18*a* of the T-bar 18 further away from the post 16. This may result in the lowermost ends of the chair 40 not being capable of being positioned on the base plates 36. The adjustable straps 28 are then positioned around the stiles 42 and back 42*a* of the chair 40 and additionally or optionally around the rear chair legs 46 and/or stretcher 44 and the rear chair legs 46 above the base plate 36. All straps 28 are tightened so that the T-bar 18 is firmly positioned against the rear chair legs 46 and to prevent the device 100 from sliding laterally. The legs 20 are then rotated so as to be perpendicular to the bars 10 12 14 and the foot 22 adjusted so that it rests on the floor.

When a young child is positioned in a seat of the chair 40, for instance in a booster seat resting on the chair seat, the legs 20 are rotating into the use position to prevent the chair from tipping over backwards even if a child sitting in the chair applies significant backwards force against the back 42*a* of the chair 40. The base plate 36, if used, and the legs 20 prevent the chair 40 from tipping. An adult pushing away from a table also cannot tilt the chair 40 backwards when the device 100 is installed on the chair 40 and in the use position. The inventor notes that the beauty of her device

100 is that once installed, it can be left on the chair 40 and the legs 20 quickly and easily folded up into the storage position when the chair is not in use, to prevent the legs 20 from otherwise being a tripping hazard. The device 100 is easily and quickly installed, so can be taken along when the family visits others or goes to restaurants and quickly and easily installed, providing the parents extra peace of mind knowing their child is safe from falls. The adjustable T-bar 18 allows the device 100 to be easier to carry by allowing the device to optionally have a "flatter" and thus more convenient carry profile.

It is to be understood that the above-described arrangements are only illustrative of the application of the principles of the present invention. Numerous modifications and alternative arrangements may be devised by those skilled in the art without departing from the scope of the present invention.

For instance, the inventor notes that the embodiment shown in the FIGS. shows a pair of legs 20 in spaced apart relationship however the device 100 can be configured with a single leg 20 positioned centrally along the post 16 that can rotate 90 degrees. The connector 30 could be configured as a hinged connector with the leg 20 and the post 16 to allow the leg 20 to be positioned for storage or use. The leg 20 could also be permanently affixed so as to be non-rotating, or the post 16 formed with a pressure fitted slot or other receiving means to allow the leg 20 to be removed and stored out of the way and then slid into the slot so as to be perpendicular to the T-bar 18. The use of two legs 20 is more stable and provides better stability, however the inventor believes it is important to note the different ways the invention can be practiced. The ability to position the leg 20 in either the storage or use positions is a key element of the device 100, as is the ability to use the device on different chair types without loss of function. The inventor also notes that the L-shaped leg shown in the FIGS. provides stability and minimizing potential tripping hazard when the device 100 is in the use position, however, the leg 20 could also be configured as a straight bar angled approximately 45 degrees from the frame such that the foot 22 is in fact one end of the bar. The straight bar could additionally be folding, telescoping or otherwise adjustable in length and perhaps additionally in angle to allow the user to decide a level of tip protection. Another variation of the leg is an approximately right-angle triangle, where the right-angle is effectively the L-shaped leg shown in the representative embodiments in the FIGS. and a hypotenuse of the triangle is the straight bar previously described. These leg variations and others are all acceptable ways to practice the invention.

The inventor notes that for the taller, barstool style chair, it may be particularly useful to adjust the T-bar 18 so that the legs 20 are positioned further away from the chair 40 to improve the anti-tip effect. The inventor is not aware of any chair anti-tip device that is portable, can be installed on any chair style, and can be quickly and easily adjusted to a storage position while still installed on the chair.

I claim:

1. An anti-tip device and chair combination, comprising:

a chair having a first chair leg and a second chair leg, the first chair leg having a back leg portion and the second chair leg having a front leg portion, the first chair leg and the second chair leg adapted to support the chair on a floor surface; and an anti-tip device having a bar having a first end, a second end and a middle portion between the first end and the second end;

a connector affixed to the bar;

a first device leg having a bar end and a floor end, the first device leg rotatably affixed to the bar by the connector; and a fastener removably affixing the bar of the device to the chair;

wherein the first device leg is in a use position when rotated so as to be perpendicular to the bar when in the use position; and wherein the first device leg is in a storage position when rotated so as to be approximately parallel to the bar.

2. The anti-tip device and chair combination in claim 1, wherein the connector is a hinge.

3. The anti-tip device and chair combination in claim 1, wherein the first device leg is affixed to the middle portion of the bar.

4. The anti-tip device and chair combination in claim 1 wherein the first device leg is a tube inserted into and rotating within the connector.

5. The anti-tip device and chair combination in claim 4, wherein the connector is further comprised of a slot and the first device leg is further formed with a stop positioned within the slot, wherein a length of the slot and the stop together limit the rotation of the first device leg within the connector.

6. The anti-tip device and chair combination in claim 1, wherein the first device leg is L-shaped.

7. The anti-tip device and chair combination in claim 1, wherein the first device leg is further configured as a right-angle triangle, or either a hypotenuse or a leg of a right-angle triangle.

8. The anti-tip device and chair combination in claim 1, wherein the first device leg is affixed to the bar at the bar end, and wherein the floor end is adapted to be positioned on the floor surface when the anti-tip device is in the use position.

9. The anti-tip device and chair combination in claim 1, wherein the fastener is an adjustable strap.

10. The anti-tip device and chair combination in claim 1, wherein the device is further comprised of a suction cup attached to a strap adapted to be removably affixed to the front leg portion of the chair.

11. The anti-tip device and chair combination in claim 1, further comprising a second device leg in space-apart relationship with the first device leg, and wherein the second device leg is perpendicular to the bar when in the use position and approximately parallel to the bar when in the storage position.

12. An anti-tip device and chair combination, the chair comprising:

a chair having a stile, and a first chair leg in spaced apart relationship with a second chair leg, with each of the first chair leg and the second chair leg terminating in a chair foot; and an anti-tip device having an upper bar having a first end, an opposed second end and a middle;

a lower bar in spaced apart relationship with the upper bar;

a post attaching the upper bar to the lower bar;

a first device leg in spaced apart relationship with a second device leg, the first device leg and the second device leg both rotatably affixed to the upper bar; and a fastener strap removably attaching either the upper bar or the lower bar of the anti-tip device or both the first device leg and the second device leg of the anti-tip device, to either the first chair leg and the second chair leg or to the stile of the chair;

wherein the anti-tip device is in a use position when the first device leg and the second device leg are rotated so as to be perpendicular to the upper bar of the anti-tip device.

13. The anti-tip device and chair combination in claim 12, the chair further comprising a third chair leg and a stretcher joining two of the first chair leg, second chair leg and third chair legs together, and the anti-tip device further comprising a suction cup affixed to a strap adapted to be removably affixed to the stretcher of the chair.

14. The anti-tip device and chair combination in claim 12, wherein the first device leg is affixed to the first end of the upper bar, the second device leg is affixed to the opposed second end of the upper bar, and wherein the post is attached to the middle of the upper bar.

15. The anti-tip device and chair combination in claim 12, further comprising a second fastener strap removably attaching either the upper bar or the lower bar of the anti-tip device to either the first chair leg or the second chair leg.

16. The anti-tip device and chair combination in claim 12, further comprising a base plate affixed to the lower bar, the base plate further formed such that the chair foot of either the first chair leg or the second chair leg rests on the base plate when in the use position, and the anti-tip device further comprising a third fastening strap removably fastening the base plate to the first chair leg or to the second chair leg of the chair.

17. The anti-tip device and chair combination in claim 12, further comprising a T-bar attached to the post, wherein the T-bar is perpendicular to the post.

18. The anti-tip device and chair combination in claim 17, wherein the T-bar is rotatably affixed to the post.

19. The anti-tip device and chair combination in claim 17 wherein the T-bar is covered at least in part with a non-slip material on a portion of the T-bar facing the chair.

20. The anti-tip device and chair combination in claim 17, wherein the T-bar is parallel to the upper bar and when in a use position rests against either the first chair leg or the second chair leg, with the upper bar of the anti-tip device in spaced apart relationship with either the first chair leg or the second chair leg of the chair.

* * * * *